US005225854A

United States Patent [19]

Stänkelström et al.

[11] Patent Number: 5,225,854

[45] Date of Patent: Jul. 6, 1993

[54] DEVICE AT AN INK JET PRINTER

[75] Inventors: Anders Stänkelström, Stockholm; Bo Bernhard, Solna, both of Sweden

[73] Assignee: Facit AB, Sundbyberg, Sweden

[21] Appl. No.: 777,367

[22] PCT Filed: May 23, 1990

[86] PCT No.: PCT/SE90/00348

§ 371 Date: Dec. 31, 1991

§ 102(e) Date: Dec. 31, 1991

[87] PCT Pub. No.: WO90/14234

PCT Pub. Date: Nov. 29, 1990

[30] Foreign Application Priority Data

May 23, 1989 [SE] Sweden ..... 8901830

[51] Int. Cl.[5] ..... B41J 2/175

[52] U.S. Cl. ..... 346/140 R

[58] Field of Search ..... 346/75, 140 R; 400/126

[56] References Cited

U.S. PATENT DOCUMENTS 4,057,807 11/1977 Fischbeck et al. ..... 346/140 R

FOREIGN PATENT DOCUMENTS 0049570 3/1982 Japan .

*Primary Examiner*—Benjamin R. Fuller
*Assistant Examiner*—Alrick Bobb
*Attorney, Agent, or Firm*—Burns, Doane, Swecker & Mathis

[57] ABSTRACT

The invention relates to an arrangement in inkjet printers of the kind in which ink droplets are propelled through a nozzle and onto a recording medium in response to an impulse. The arrangement includes a detachable ink container which includes the nozzle through which ink droplets are propelled, and an ink chamber which is located adjacent to the nozzle. The ink chamber is defined on at least one side by an elastic wall, and adjacent to the elastic wall there is provided a shock-wave generating device. When the device is activated, it moves axially into impact with the elastic wall, such as to generate a shock wave which propagates through the ink chamber and causes an ink droplet to be propelled through the nozzle.

6 Claims, 2 Drawing Sheets

DEVICE AT AN INK JET PRINTER

The present invention relates to an arrangement in inkjet printers of the kind in which, in response to an applied impulse, ink droplets are intended to be propelled through an ink nozzle or jet onto a recording medium, and particularly of the kind which include a detachable ink container which includes the nozzle through which ink droplets can be propelled and an ink chamber located adjacent the nozzle.

The use of detachable ink containers with inkjet printers is known to the art, for instance from U.S. Pat. No. 4,057,807. In the case of the ink container known from the aforesaid Patent Specification, one wall of the ink container is constructed of two laminated layers each consisting of mutually different materials having mutually different tensioning properties in the presence of a magnetic field, therewith causing the laminated material to bend when a magnetic field is applied. Accordingly, a drive means in the form of an electromagnet is placed over the laminated layer, so that when current is passed through the drive means, the laminated layer will bend outwards and therewith reduce the volume of the ink chamber. The detachable ink container thus includes part of the activating means required to propel ink droplets.

A similar arrangement is also known from JP abstract 57-49570, this arrangement also including a coil-activated plate which defines one wall of an ink chamber and which functions to achieve propulsion of the ink droplets. This plate must also have special properties in order to be able to move when influenced by the coil, and the plate belongs to the detachable part.

The object of the present invention is to provide a novel and improved arrangement in inkjet printers of the kind which include a detachable ink container, such as to enable the ink container to be produced from an inexpensive material so that the container can be viably scrapped after being used only once.

This object is achieved by means of the present invention, which is characterized by the features set forth in the following claims.

Figure 1:
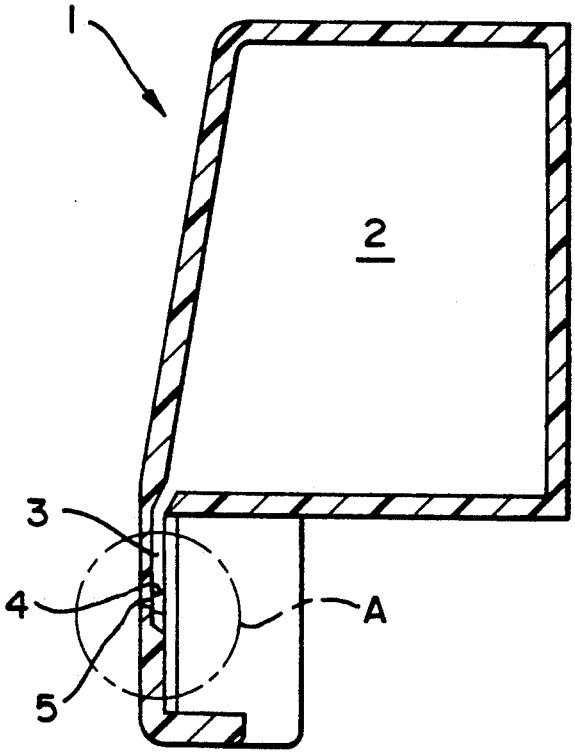
Figure 2:
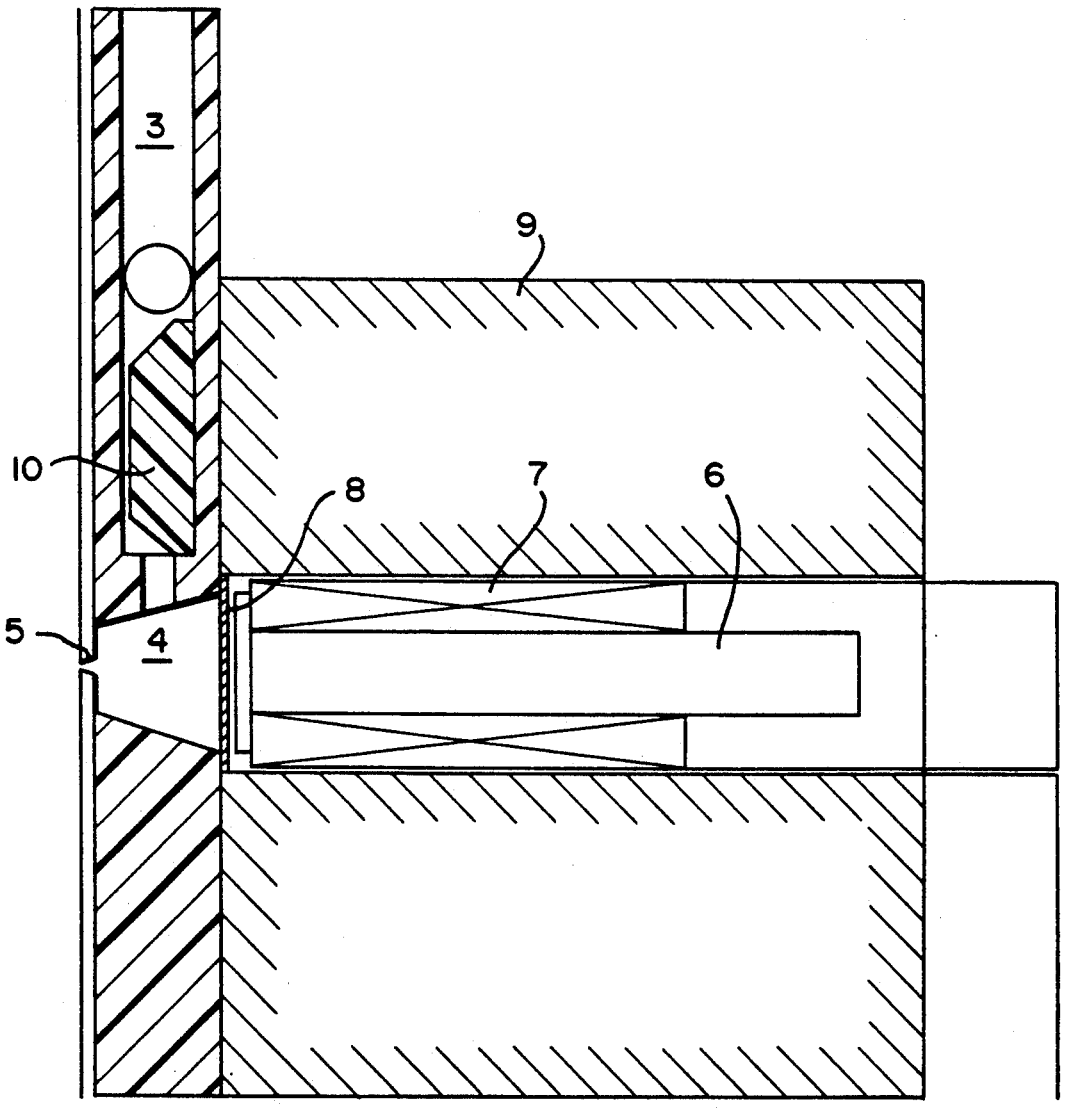

The invention will now be described in more detail with reference to a non-limiting, exemplifying embodiment thereof illustrated in the accompanying drawings, wherein FIG. 1 is a cross-sectional view of an inventive ink container, and FIG. 2 illustrates in larger scale the area marked A in FIG. 1, and also illustrates an activating device.

Thus, FIG. 1 illustrates a detachable ink container 1 which includes a large reservoir chamber 2 from which a delivery conduit 3 extends down to an ink chamber 4, and a nozzle 5 which is located adjacent the ink chamber 4. The ink container 1 is preferably provided with a large number of ink chambers 4 and nozzles 5, the delivery conduit 3 being configured as a manifold conduit extending from the reservoir chamber 2. The ink chambers 4 and nozzles 5 may then be disposed in a row perpendicular to the plane of the paper in FIG. 1.

An activating device is located behind the ink chamber 4 and functions to effect propulsion of ink droplets through the nozzle 5, therewith to carry out the desired printing operation. As illustrated in FIG. 2, the activating device has the form of a rod 6, which may optionally be made of a magnitostrictive material and which is embraced by an electric coil 7. These components are disposed in the part which is fixedly connected to the printer and are thus not detachable together with the detachable ink container. Located between the rod 6 and the ink chamber 4 is an elastic wall 8 which can either be attached to that part which can be detached from the ink container 1 or mounted in a housing 9 in which the rod 6 and the coil 7 are mounted. The elastic wall 8 extends over the whole of the ink chamber 4 in a direction towards the rod 6, and the ink chamber 4 is open towards the elastic wall 8.

The elastic wall 8 may conveniently be a diaphragm which is intended to close one wall of the ink chamber 4.

When the coil 7 receives a current pulse, the rod 6 is moved axially in a direction towards the elastic wall 8, which therewith bulges briefly into the ink chamber 4. In this way, there is generated in the ink chamber 4 a shock wave or surge which propagates through the ink in the chamber 4 up to the nozzle 5 and results in the propulsion of an ink droplet through the nozzle. In order to prevent the shock wave from returning solely through the delivery conduit 3, a flow restrictor 10 can be arranged in the delivery conduit, as indicated in FIG. 2.

An advantage is afforded when the elastic wall 8, the diaphragm, is attached to the housing part 9, since this will allow the rod 6 to be biased into abutment with the elastic wall 8. In this case, a further diaphragm or elastic wall may be required to close the ink chamber 4 on the side thereof facing towards the elastic wall 8, although when using an ink which is solid at room temperature and which converts to a liquid state when heated slightly, this wall of the ink chamber 4 can be left open to no disadvantage and without risk of the ink flowing out through this open side of the chamber.

A detachable ink container of the aforedescribed kind can be configured in a manner which will enable it to be readily exchanged in an inkjet printer, simply by inserting the container in its correct position in front of the shock-wave generating device, and may be provided with appropriate guide means which guarantee that the detachable ink container will always be located in the correct position.

As a result of the inventive arrangement, the whole of the activating device is located in the housing-attached part and is therewith not present in the non-disposable part. Notwithstanding this, the construction of the activating device is not complicated and is able to coact with the detachable unit in a positive manner.

We claim:

1. An arrangement in an inkjet printer in which droplets are propelled through a nozzle and onto a recording medium in response to an impulse, comprising:

a detachable ink container which includes the nozzle through which ink droplets can be propelled, an ink chamber which is located adjacent the nozzle and which is defined by an elastic wall on at least one side thereof, wherein arranged on a side of the elastic wall which faces outwardly from the chamber is a shock-wave generating device which is separate from the detachable ink container and which includes a coil and a rod which is movable in said coil and which functions to strike against the elastic wall such as to generate a shock wave in the ink chamber; and, the ink container with the ink chamber and the nozzle is detachable from the shock-wave generating device.

2. An arrangement according to claim 1, wherein the elastic wall is a diaphragm.

3. An arrangement according to claim 1 or 2, wherein the movable rod is constructed from a magnetostrictive material.

4. An arrangement according to claim 1, wherein the ink container is common to several nozzles and several ink chambers.

5. An arrangement according to claim 1, wherein the elastic wall is attached to a housing which includes the shock-wave generating device and wherein the ink is solid at room temperature.

6. An arrangement according to claim 1, wherein the elastic wall is connected to the detachable ink container.

* * * * *